US007040547B1

(12) United States Patent
Nelson

(10) Patent No.: US 7,040,547 B1
(45) Date of Patent: May 9, 2006

(54) STRAW WITH ANGLED OUTPUT

(76) Inventor: David Nelson, 10 WestBrook La., Attleboro, MA (US) 02703

( * ) Notice: Subject to any disclaimer, the term of this patent is extended or adjusted under 35 U.S.C. 154(b) by 0 days.

(21) Appl. No.: 10/944,657

(22) Filed: Sep. 20, 2004

Related U.S. Application Data

(60) Provisional application No. 60/516,087, filed on Oct. 31, 2003.

(51) Int. Cl.
*A47G 21/18* (2006.01)
*B65D 77/28* (2006.01)

(52) U.S. Cl. ..... 239/33; 239/16; 239/24; 229/103.1; 426/85; 215/705

(58) Field of Classification Search ..... 239/33, 239/103.1, 16, 24; 426/85; 215/229, 388, 215/399; 220/705–710; D7/300.2
See application file for complete search history.

(56) References Cited

U.S. PATENT DOCUMENTS 1,012,193 A * 12/1911 Deffner ..... 239/33
2,943,794 A * 7/1960 Sussman ..... 239/33
2,997,195 A * 8/1961 Yuen ..... 239/33
3,398,624 A * 8/1968 Stoessel et al. ..... 239/33
5,766,194 A * 6/1998 Smith ..... 606/167
6,375,091 B1 4/2002 Cha ..... 239/33
6,460,777 B1 10/2002 Float et al.
D487,375 S * 3/2004 Bengtsson et al. ..... D7/300.2
D497,509 S * 10/2004 Nelson ..... D7/300.2
D497,764 S * 11/2004 Nelson ..... D7/300.2

* cited by examiner

*Primary Examiner*—David A. Scherbel
*Assistant Examiner*—Seth Barney

(57) ABSTRACT

The present invention relates to a drinking straw that diverts the flow of liquid away from the upper palate, thereby avoiding discomfort or pain in the upper palate and posterior pharyngeal wall of the mouth. The drinking straw includes an elongate tubular body having a first side surface and a second side surface. At one end of elongate body is an opening defining an intake or suction spout that is to be placed within a beverage container. At the opposite end, an output spout is designed to allow for redirection of a fluid downward and away from the upper palate.

16 Claims, 8 Drawing Sheets

STRAW WITH ANGLED OUTPUT

CROSS-REFERENCE TO RELATED APPLICATIONS

This application claims the benefit of provisional application Ser. No. 60/516,087 filed 31 Oct. 2003.

FIELD OF THE INVENTION

This invention relates to a drinking straw for drinking cold liquids and the like. More particularly, the drinking straw of the present invention provides for the divergence of liquid at its output to prevent the flow of liquid to the upper palette, thereby reducing the likelihood of cold headaches.

BACKGROUND OF THE INVENTION

Drinking straws are commonly used as a means to consume nourishing liquids. Conventional straws typically cause a liquid to be drawn through the straw and projected directly to the upper palate of the mouth. In the case of a cold liquid, a condition called "brain freeze" or headache can result and last for up to 20 seconds after the liquid touches the upper palate and posterior pharyngeal wall of the mouth. This pain is usually located in the midfrontal area, but can be unilateral in the temporal, frontal, or retro-orbital region of the head. Drinking straws that address objectives of diverting the flow of liquid away from the upper palate, such as U.S. Pat. No. 6,375,091 to Cha, exist in the prior art. Cha discloses a straw that includes an output opening comprising an output shield and a first projection for diverting a fluid downward towards the tongue rather than striking the roof of the mouth. Cha contemplates a straw with a plurality of projections and extensions that make it impractical to be mass-produced in a cost effective manner. Furthermore, it is not apparent that this type of structure would effectively divert a flow of liquid, considering the lack of structural stability of these independent plastic projections while under pressure from a liquid.

SUMMARY OF THE INVENTION

The present invention provides a drinking straw that treats and overcomes the problems sought to be solved but never fully attained by the prior art. The present drinking straw is a uniquely different approach to the resolution of the problems experienced by the prior art. It provides a singular unitary structure with an integrated output spout that exhibits superior structural integrity over the prior art. The straw of the present invention effectively diverts the flow of liquid at the output to the tongue, thereby avoiding discomfort or pain in the upper palate and posterior pharyngeal wall of the mouth. The above description, as well as features and advantages of the present invention, will be more fully appreciated by reference to the following detailed description of a presently preferred, but nonetheless illustrative, embodiment in accordance with the present invention when taken in conjunction with the accompanying drawings.

BRIEF DESCRIPTION OF THE DRAWINGS

The invention is best understood from the following detailed description when read in connection with the accompanying drawings, which illustrate an embodiment of the present invention.

DETAILED DESCRIPTION OF THE INVENTION

Figure 1:
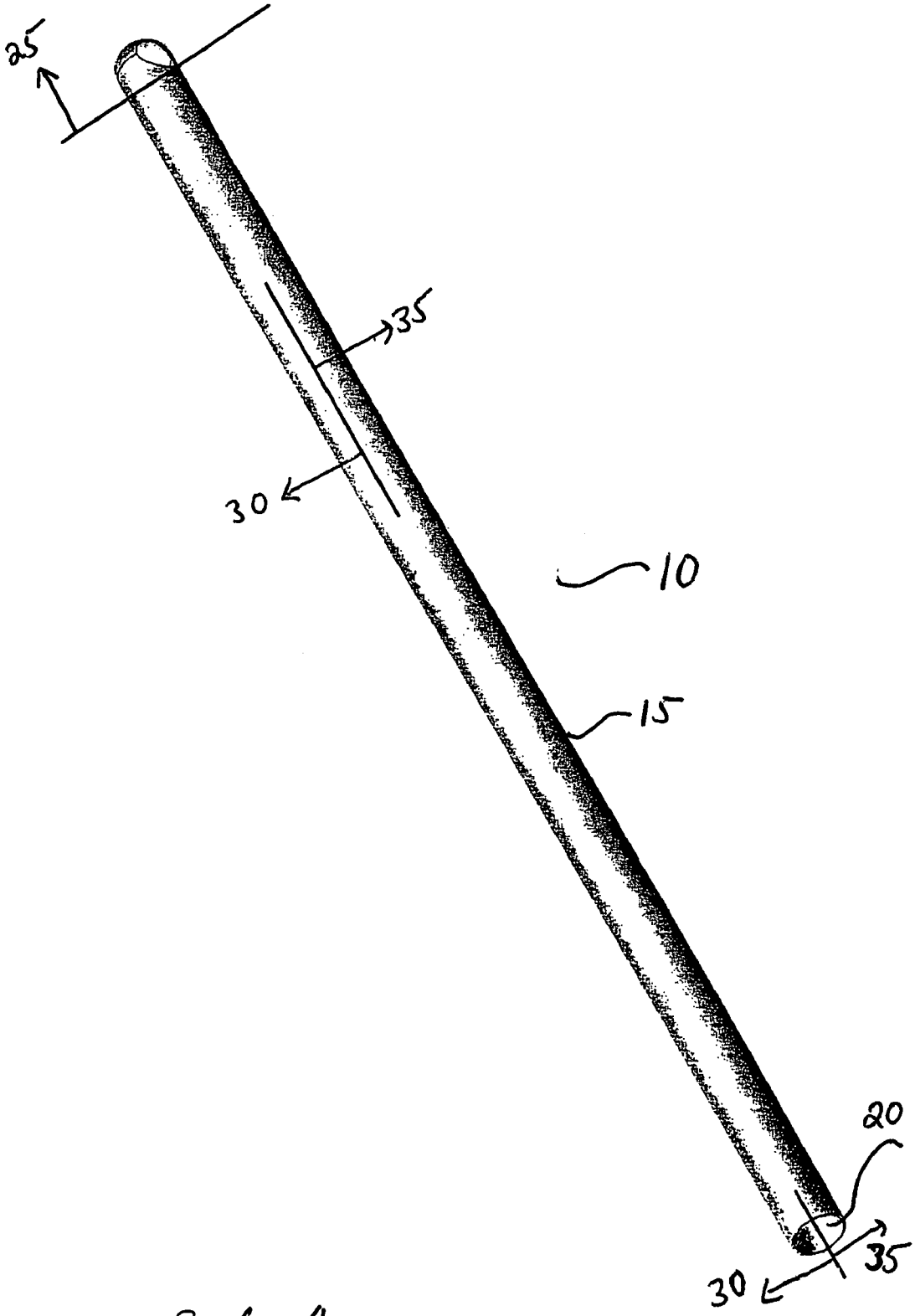
FIG. 1 is a perspective view of the straw of subject invention.
Figure 2:
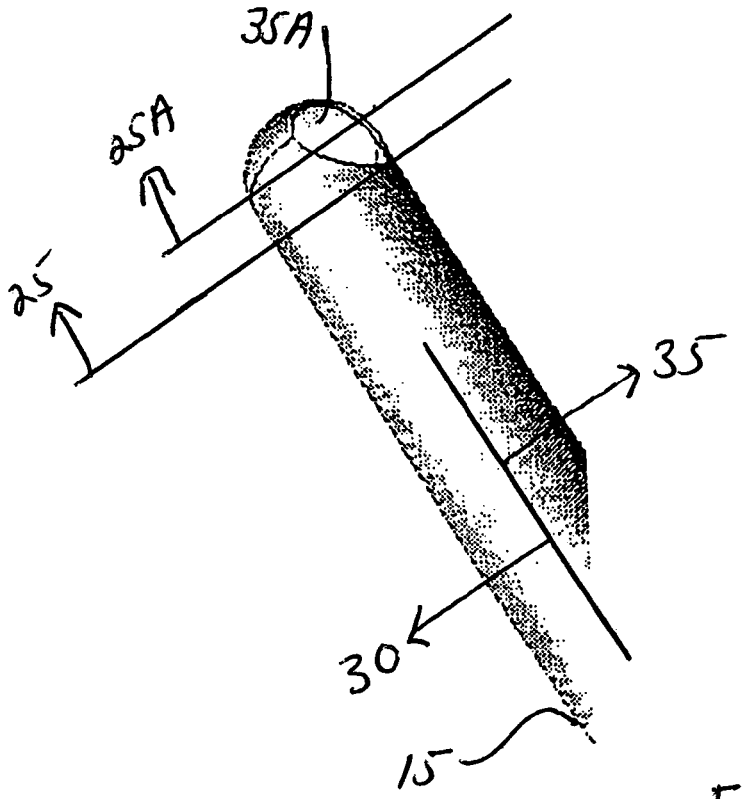
FIG. 2 is an expanded view of the output spout 25 of subject invention.
Figure 3:
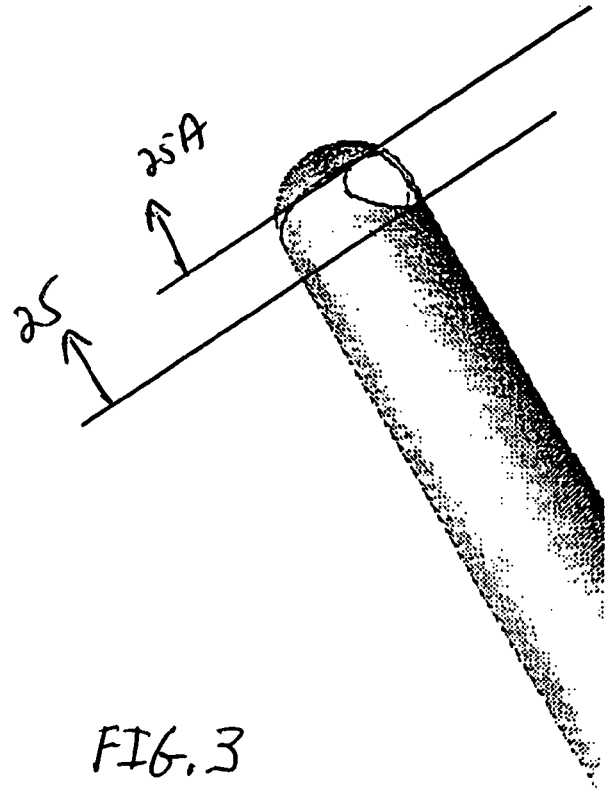
FIG. 3 is an alternative embodiment of output spout 25 of subject invention.
Figure 4:
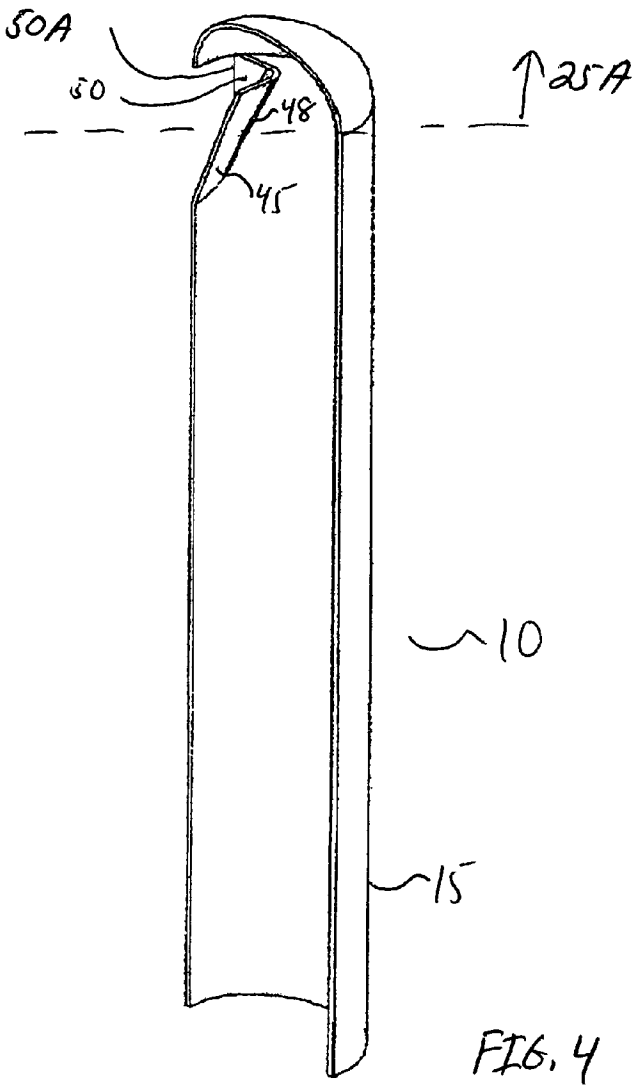
FIG. 4 is a cutaway view of an alternative embodiment of subject invention.
Figure 5:
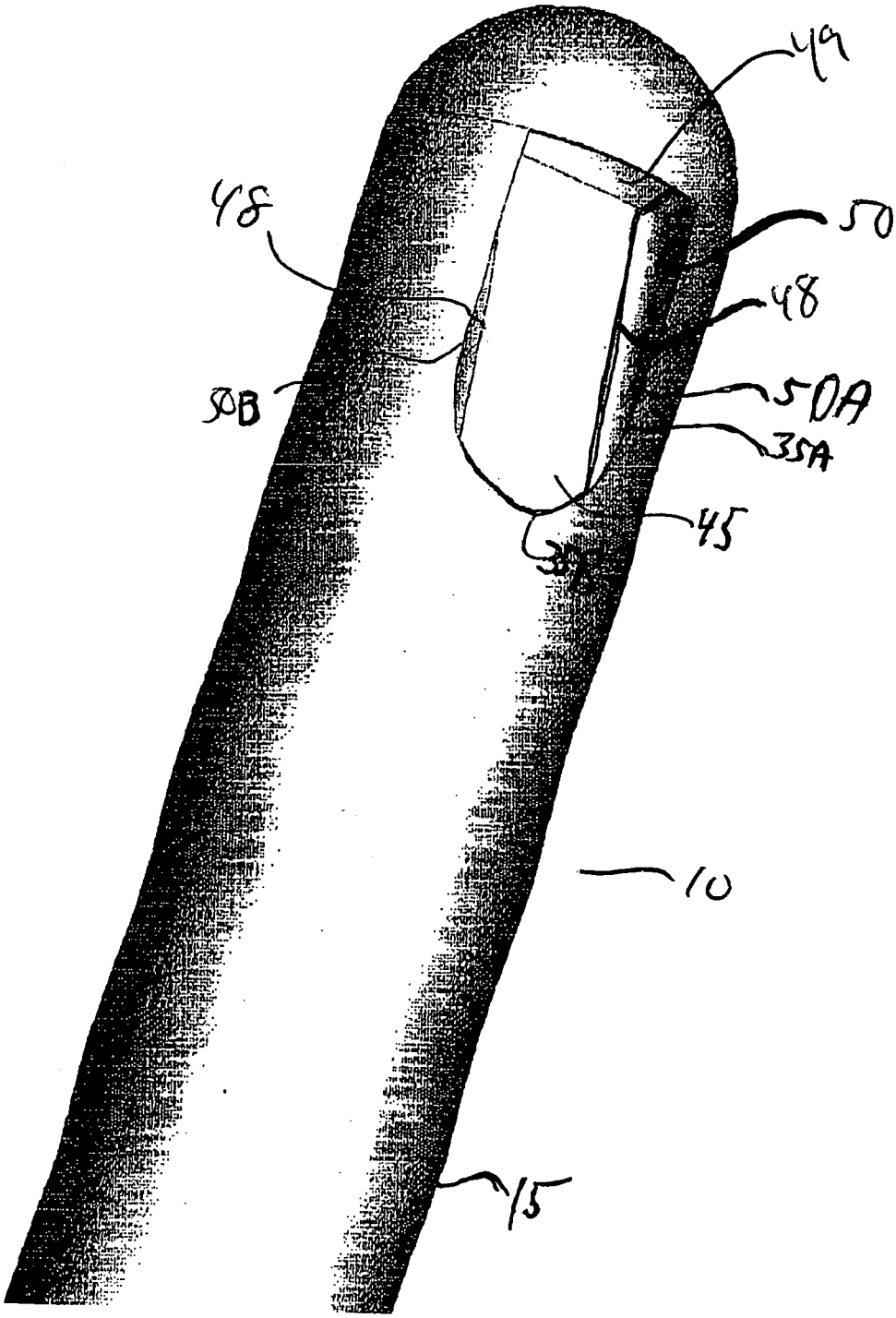
FIG. 5 is a full view of the alternative embodiment of FIG. 4.
Figure 6:
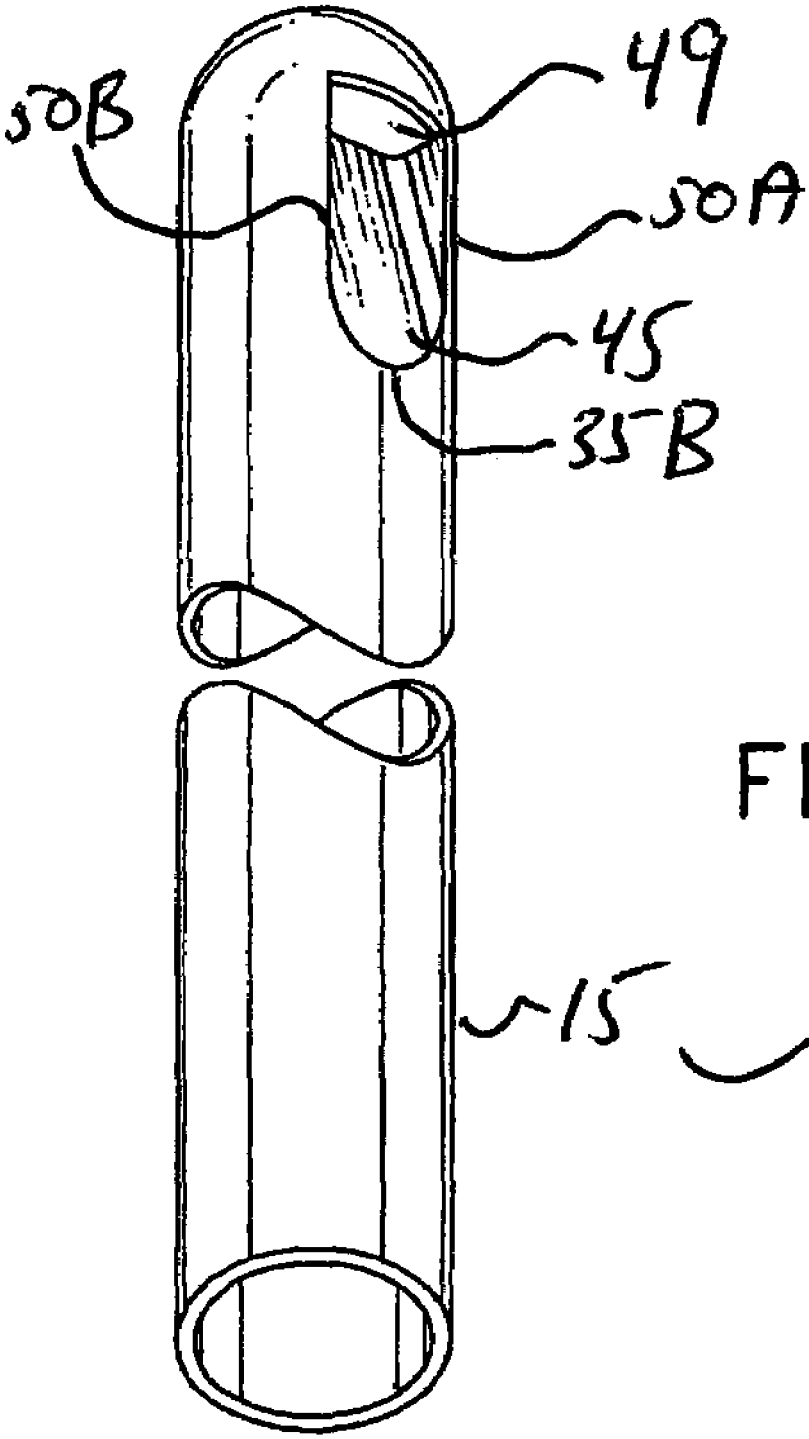
FIG. 6 is a right side view of the embodiment of FIG. 4.
Figure 7:
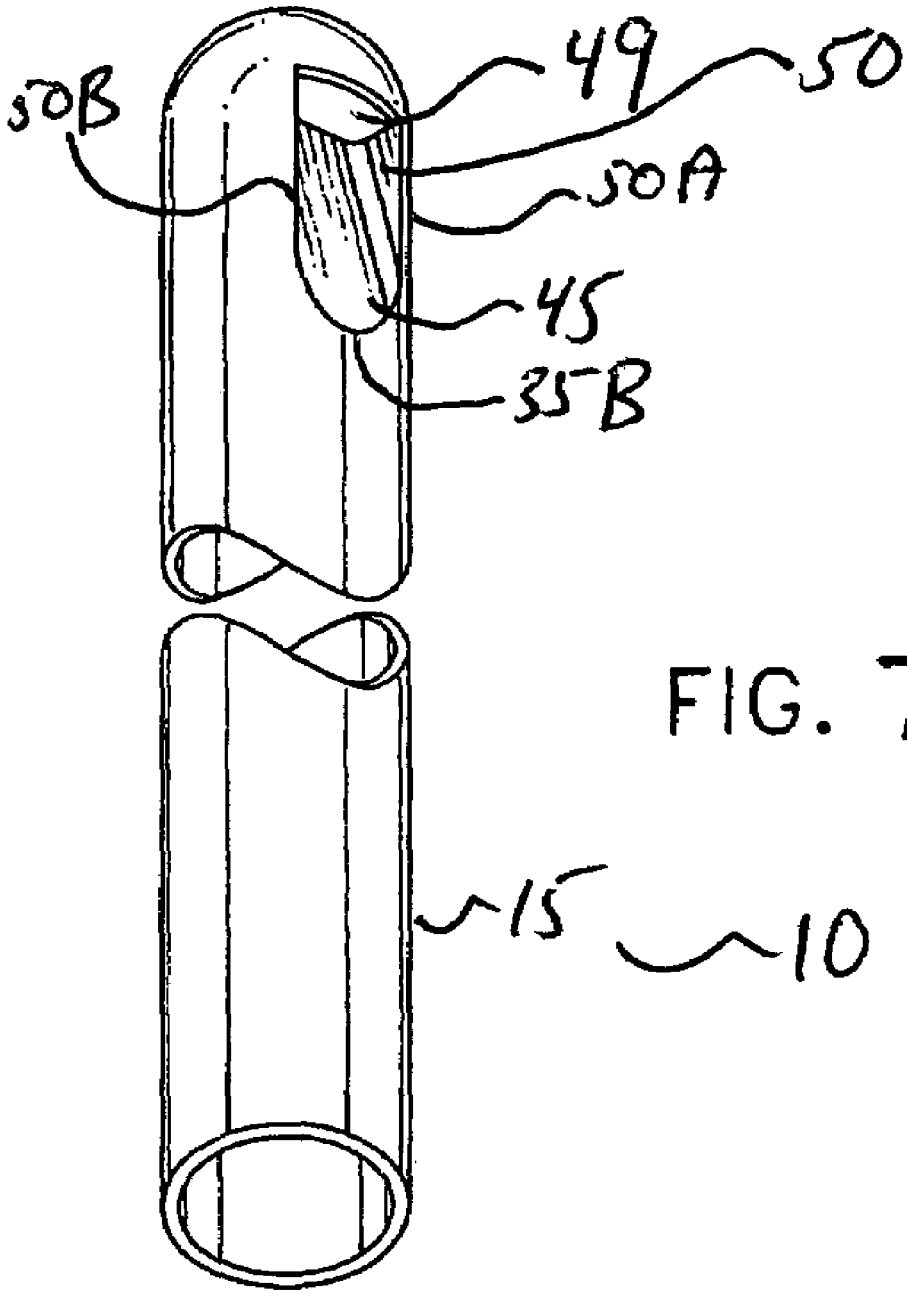
FIG. 7 is a left side view of the embodiment of FIG. 4.
Figure 8:
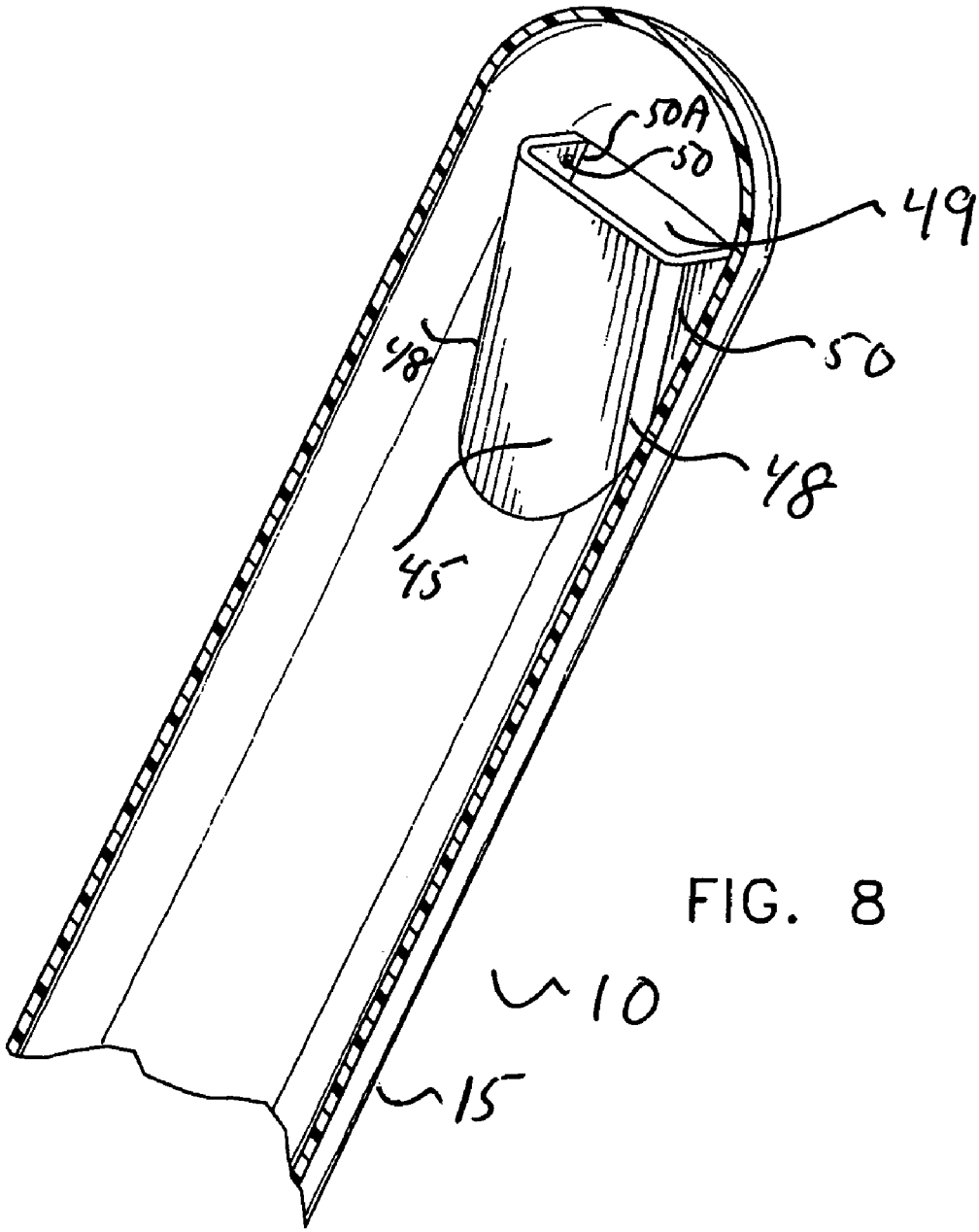
FIG. 8 is an alternate cutaway view of FIG. 4.
Figure 9:
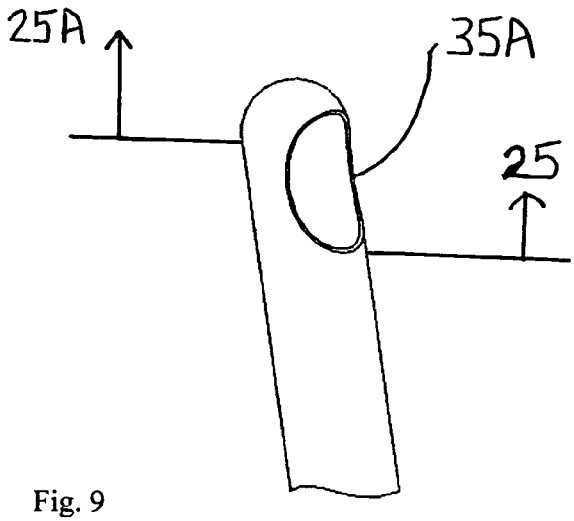
FIG. 9 illustrates an alternative embodiment of subject invention showing output spout 25 with an oval opening 35A.
Figure 10:
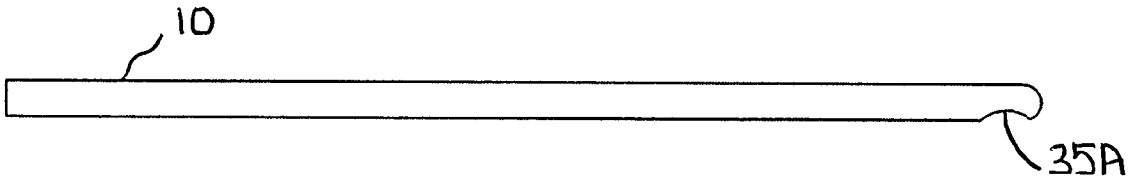
FIG. 10 illustrates a side view of the straw of FIG. 9.
Figure 11:
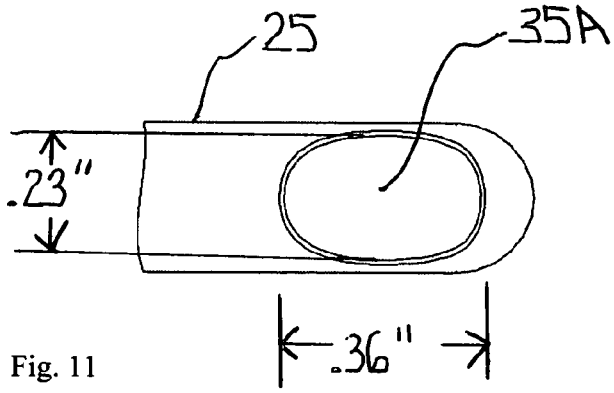
FIG. 11 illustrates a top view of subject invention showing output spout 25 and oval opening 35A.

Referring to FIG. 1, the straw of the present invention is generally identified by the numeral 10. In the preferred embodiment, straw 10 has an elongate tubular body 15 having a first side surface 30 and a second side surface 35. At one end of elongate body 15 is an opening 20 defining an intake or suction spout that is to be placed within a beverage container. At the opposite end, an output spout 25 having a closed top is designed to allow for redirection of a fluid downward and away from the upper palate. Referring to FIG. 2, output spout 25 is contiguous with first side surface 30 and second side surface 35 of tubular body 15 and includes a semi-spherical end 25A. Output Spout 25 further includes an opening 35A to allow for fluid to exit downward as it is siphoned upward through tubular body 15 and into the interior volume of semi-spherical end 25A. Semi-spherical end 25A diverts liquid towards opening 35A and allows for up to ninety degrees of redirection of a liquid. This redirection causes a liquid to be projected downward towards the tongue rather than straight towards the upper palate. In practice, straw 10 would be positioned in a users mouth such that opening 35A is facing towards the tongue of a user, or downward. Opening 35A may be cut along other areas of output spout 25 or side surface 35 still effectively diverting the flow of liquid downward. For example, opening 35A may be moved downward such that there is no intersection with semispherical end 25A as illustrated in FIG. 3. It is understood that semispherical end 25A and opening 35A may be any geometrical shape that remains contiguous with elongate body 15. As illustrated in FIGS. 9 through 11, an alternative embodiment of straw 10 is illustrated wherein opening 35 is oval shape with preferred dimensions of oval opening 35A being about 0.36 inches in length and about 0.23 inches in width. Furthermore, other preferred dimensions include a straw 10 length of about 8 inches, straw material thickness of about 0.008 inches, and input end/intake opening outside diameter of about 0.28 inches. Also, semispherical end 25A could be any spherical, domed or edge shape that would allow for diversion of liquid towards opening 35A. Referring to FIGS. 4 through 7, an alternative embodiment of straw 10 is disclosed. Opening 35A includes an extension 45 projecting inward into the interior volume of semi-spherical end 25A. Extension 45 is attached at score line 35B at the base of opening 35A. The angle of extension 45 can be changed from 0 to 90 degrees to change the flow characteristics of the liquid being siphoned upward. Referring to FIG. 4, a cutaway view of the straw 10, cut in half, is illustrated. It is understood that a symmetrical opposite half exists to define the complete straw 10. Extension 45 includes symmetrical side members 50 joined to symmetrical extensions 45 at symmetrical lineal score lines 48. Symmetrical side members 50 are attached to the interior of elongate tubular body 15 at lineal score lines 50A and 50B. Symmetrical side members 50 serve to secure symmetrical extensions 45 in place and allow for fluid to be channeled through opening 49 as it is siphoned upward through tubular body 15 and into the interior volume of semispherical end 25A. FIGS. 6 and 7 show left and right side views of straw 10 and illustrate the symmetry of opening 35A. FIG. 8 illustrates an alternate cutaway view of straw 10 showing symmetrical side members 50 and extension 45 as a one piece impression contained within the interior of elongate tubular body 15. Straw 10 is generally formed as a monolithic tube but may be formed in a variety of shapes and sizes. In the manufacture of straw 10, the same may be made of a single body of material that may be continuous and coextensive throughout its length so that the hollow tube will provide a path for the flow of liquid there along from its intake end 20 to its output spout 25. The tube provides the siphon path along which a liquid may be withdrawn to the output spout 25 where it is then drunk and ingested by the user. The straw 10 may be constructed of any desired material. In particular, plastic such as food grade polypropylene or homopolymer has been found to be convenient and practical because it can be extruded in continuous and desired lengths.

It is further understood that the preceding is merely a detailed description of one embodiment of this invention and that numerous changes to the disclosed embodiment can be made in accordance with the disclosure herein without departing from the spirit or scope of the invention. Rather, the scope of the invention is to be determined only by the appended claims and their equivalents.

I claim:

1. A straw comprising:

a one piece elongate hollow body having a first side surface and a second side surface;

an input end contiguous with said hollow body; and an output end, said output end contiguous with said hollow body, said output end opposite said input end, said output end having a closed top, said output end having an opening on said second side surface, said opening defined by the removal of material from said second side surface, said opening providing an unrestricted downward exit for fluid as it is siphoned upward through said input end, said closed top diverting said fluid through said opening.

2. A straw according to claim 1 wherein said closed top is semi-spherical.

3. A straw according to claim 2 wherein said semi-spherical closed top diverts said upward siphoned fluid up to ninety degrees.

4. A straw according to claim 1 wherein said elongate hollow body is cylindrical.

5. A straw according to claim 1 wherein said output end opening is oval.

6. A straw according to claim 5 wherein said oval output end opening is about 0.36 inches long and about 0.23 inches wide.

7. A straw according to claim 1 wherein said closed top is domed.

8. A straw according to claim 1 wherein said elongate hollow body is about 8 inches.

9. A straw according to claim 1 wherein said straw is made from plastic, said plastic having a material thickness of about 0.008 inches.

10. A straw according to claim 1 wherein said input end of said elongate hollow body has a diameter of about 0.28 inches.

11. A straw comprising:

one piece elongate hollow body having a first side surface and a second side surface;

an input end contiguous with said hollow body; and an output end, said output end contiguous with said hollow body, said output end opposite said input end, said output end having a closed top, said second side surface having an opening, said opening defined by the removal of material from said second side surface, said opening providing an unrestricted downward exit for fluid as it is siphoned upward through said input end, said closed top diverting said fluid through said opening.

12. A straw according to claim 11 wherein said contiguous output end is semi-spherical, said semi-spherical output end diverting said fluid through said opening as it is siphoned upward through said input end.

13. A straw comprising:

an elongate hollow body having a first side surface and a second side surface;

an input end contiguous with said hollow body; and an output end, said output end contiguous with said hollow body, said output end opposite said input end, said output end having a closed top, said output end having an opening on said second side surface, said opening comprising, a first side member;

a second side member; and an extension, said first side member and said second side member projecting inward from said second side surface into the interior of said elongate hollow body, said first side member having a first side member edge, said second side member having a second side member edge, said first side member first edge and said second side member second edge attached along a portion of the periphery of said extension, said extension projecting inward into the interior volume of said elongate hollow body, a portion of said extension attached to a portion of said second side surface, said first side member, said second side member, and said extension defining said opening, said extension redirecting the flow of said siphoned fluid towards said closed top, said closed top diverting said fluid through said opening.

14. A straw according to claim 13 wherein said closed top is semi-spherical.

15. A straw according to claim 13 wherein said extension projects inward up to 45 degrees from said second side surface.

16. A straw according to claim 11 wherein said elongate hollow body is cylindrical.

* * * * *